US005564341A

United States Patent [19]

Martin

[11] Patent Number: 5,564,341

[45] Date of Patent: Oct. 15, 1996

[54] COUPLING ASSEMBLY BETWEEN TWO SUCCESSIVE WAGON STRUCTURES AND A COMMON BOGIE

[75] Inventor: Bruno Martin, Strasbourg, France

[73] Assignee: Lohr Industrie, S.A., Hangenbieten, France

[21] Appl. No.: 381,871

[22] PCT Filed: Aug. 19, 1993

[86] PCT No.: PCT/FR93/00817

§ 371 Date: Feb. 14, 1995

§ 102(e) Date: Feb. 14, 1995

[87] PCT Pub. No.: WO94/04406

PCT Pub. Date: Mar. 3, 1994

[30] Foreign Application Priority Data

Aug. 20, 1992 [FR] France ..... 92 10242

[51] Int. Cl.[6] ..... B61F 3/12

[52] U.S. Cl. ..... 105/4.1; 105/4.2; 105/159; 105/199.1; 105/355; 410/53

[58] Field of Search ..... 105/4.1, 42, 159, 105/199.1, 238.1, 355; 410/53, 56

[56] References Cited

U.S. PATENT DOCUMENTS

| | | | |
|---|---|---|---|
| 4,456,413 | 6/1984 | Pavlick | 105/4.1 |
| 4,750,431 | 6/1988 | Yates et al. . | |
| 4,841,876 | 6/1989 | Gramse et al. | 105/4.1 |
| 5,216,956 | 6/1993 | Adams Jr. | 105/159 |
| 5,291,835 | 3/1994 | Wicks | 105/4.2 |

FOREIGN PATENT DOCUMENTS

| | | | |
|---|---|---|---|
| 0403021 | 12/1990 | European Pat. Off. . | |
| 477115 | 3/1992 | European Pat. Off. | 105/159 |
| 481904 | 4/1992 | European Pat. Off. | 105/4.1 |

*Primary Examiner*—Robert J. Oberleitner
*Assistant Examiner*—S. Joseph Morano
*Attorney, Agent, or Firm*—Schwartz & Weinrieb

[57] ABSTRACT

An assembly for coupling to the same bogie the opposite ends of two successive wagon structures having a "V"-shaped front end (18) articulated on the bogie and an open rear end (13) consisting of two parallel arms (14, 15) has a pivoting cross member (26) on the bogie integrated with the "V"-shaped front end of the first wagon structure by which the preceding wagon structure is coupled, the pivoting cross member (26) comprising at each of its ends a receiving support (30, 31) equipped with an immobilizing device for each of the ends of the arms of the rear end (13) of the preceding wagon structure. The ends of the arms (14, 15) each have a junction structure cooperating with each receiving support.

18 Claims, 4 Drawing Sheets

COUPLING ASSEMBLY BETWEEN TWO SUCCESSIVE WAGON STRUCTURES AND A COMMON BOGIE

FIELD OF THE INVENTION

The present invention relates to a coupling assembly between two successive wagon structures and a common bogie.

TECHNICAL BACKGROUND OF THE INVENTION

The considerable development of road transport in industrialized countries has obliged industry to find means for rapid rail/road conversion and vice versa or for transportation of totally or partially constituted road units in order to relieve the road network without losing the advantages of road transport.

French Patent Application Nos. 91 10590, 92 02763 and 92 02764 in the name of the Applicant relate to a wagon structure with an underslung base equipped with integral lifting means and means for coupling the adjacent ends of two successive wagon structures to one and the same bogie, permitting the implementation of various loading and unloading procedures in a handling area or a marshalling yard.

The wagon structure described in these applications exhibits most of the numerous advantages desired, in particular simplicity of construction, as well as lateral transfer possibilities.

However, the couplings between the wagon structures and the approach, joining and locking maneuvers require precise, delicate handling demanding a certain skill and sustained attention. In fact, coupling of each rear end of a wagon structure to the bogie requires centering prior to fitting.

This detracts from the speed and security of transfer, handling and train-forming operations.

OBJECT OF THE INVENTION

The present invention enables these disadvantages to be remedied in a manner which will satisfy all the demands relating to this type of wagon structure.

SUMMARY OF THE INVENTION

To this end, the invention relates to a coupling assembly between successive wagon structures and a common bogie, each wagon structure comprising, on the one hand, a front end formed by two branches converging to a point, and an open rear end defined by two parallel arms in the manner of a side sill. A common articulated assembly on the pivotally receives the front end point and a pivoting cross member comprising at each of its ends a receiving support for the arms of the open rear end of the preceding structure, the arms having at their ends junction means cooperating with the receiving supports with a view to the rapid coupling of the rear end.

The means for establishing and maintaining the connection with the preceding wagon structure comprises, at each end of the pivoting cross member, a resiliently returnable transverse immobilizing pin emerging transversely from each receiving support and a receiving and extraction mechanism at each of the ends of the rear end arms of the preceding wagon structure.

In this way, the coupling and uncoupling maneuvers are both simpler and quicker. In fact, the need for effecting the correspondence of members or mechanical parts before the coupling stage has been totally dispensed with.

BRIEF DESCRIPTION OF THE DRAWINGS

The technical characteristics and other advantages of the invention may be found in the following description of one embodiment, made by way of a non-limiting example and with reference to the accompanying drawings, in which like reference characters designate like or corresponding parts throughout the several views, and wherein.

DETAILED DESCRIPTION OF THE INVENTION

Figure 1:
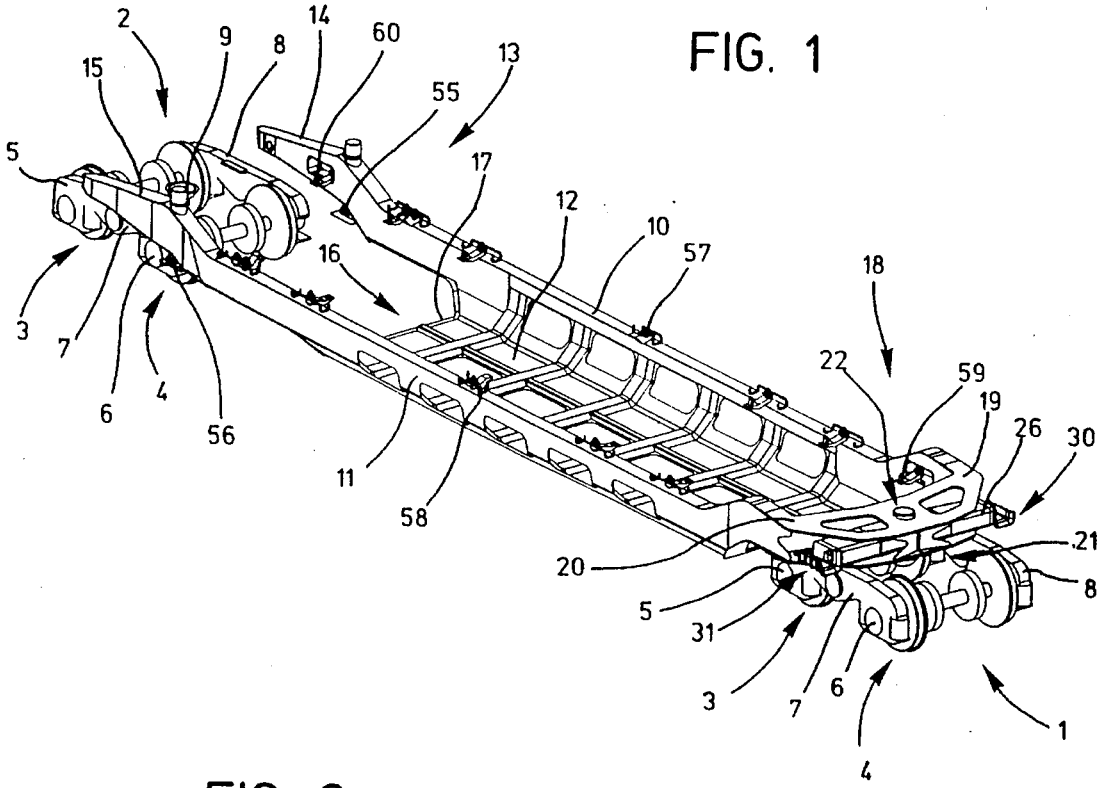
FIG. 1 is a general perspective view of an improved wagon structure, in reverse position, showing at its front end the main variant of the coupling assembly according to the invention.
Figure 2:
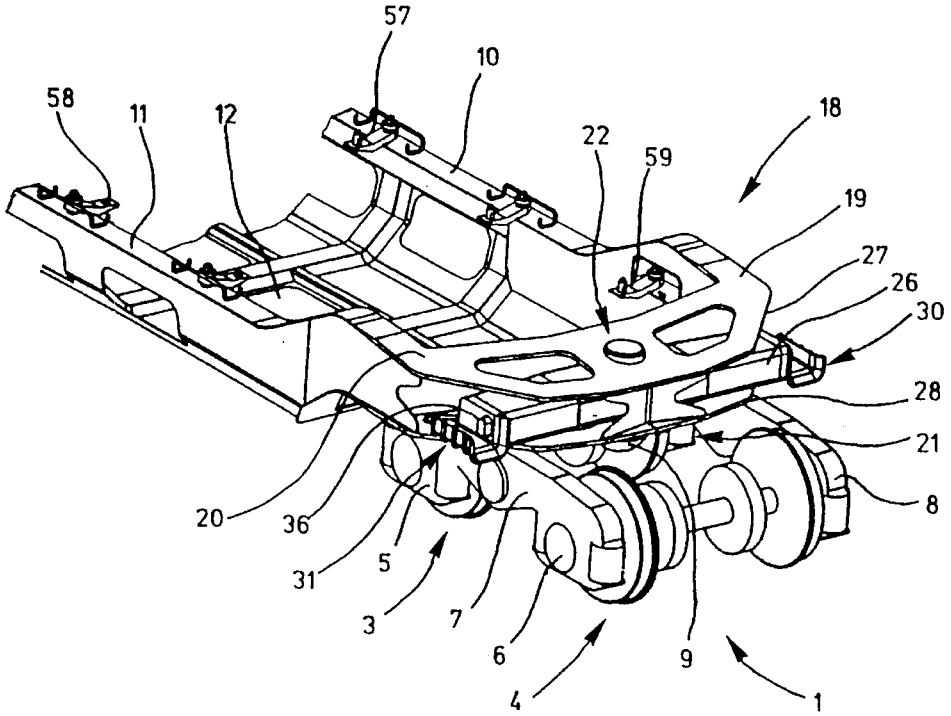
FIG. 2 is a perspective view of the front end of the wagon structure and of the bogie interface on which it is mounted.

The coupling assembly according to the invention is designed for particular wagon structures, in particular of the type described in the above-mentioned prior applications.

This type of structure is a load-bearing structure fulfilling railroad standards and designed to be coupled in a separable manner by each of its ends to the opposite ends of preceding and succeeding adjoining structures and by an interface to a common bogie, the bogie interface being identical for all the bogies on the same railroad train.

In a manner which is non-limiting and non-restrictive in application, and for reasons of clarity and sufficiency of description, we shall firstly describe below the general bogie interface means which are the subject matter of a parallel protection and which are capable of receiving at their ends, in a separable manner, the wagon structure according to the invention, and at the same time the general characteristics of this wagon structure.

A front bogie 1 or rear bogie 2 traditionally comprises two axles 3 and 4 which optionally carry brake disks.

The ends of the axles are mounted in bearing boxes such as 5 and 6 supporting paired blocks 7 and 8 forming, with various other mechanical elements, an underframe which is not shown in detail. This underframe conventionally supports at least one ball joint known as a center-casting 9.

This ball joint commonly receives in a pivotal manner, the lower end structure of the conventional wagon supported by the bogie.

For reasons of drawing clarity, only the main structures of the bogies have been shown in the Figures. Thus, certain existing mechanical linkage supports are not visible.

This common bogie interface, adaptable to all current railroad rolling stock, is used to articulate and connect the front and rear ends of two successive wagon structures to one and the same bogie through the intermediary of the coupling according to the invention.

There now follows a brief description, with reference to FIG. 1, of a wagon structure for integration into a train between two like structures and for mounting on the two bogies, front bogie 1 and rear bogie 2, through the intermediary of couplings according to the invention.

The structure comprises two side members 10 and 11 connected together at the level of their base by an underslung base 17.

The side members are extended towards the rear end 13 at a higher level by two parallel arms 14 and 15 in the manner of side sills, defining with their edges adjoining the side members and the transverse base end, an access opening 16 for a load.

The general construction of the rear end visible in the Figures is such that the opening plane thereof is set back considerably with respect to the ends of the arms.

Thus, the rear transverse edge 17 of the base 12 is displaced forwardly so as to permit the tractor of a semi-trailer truck to remain on the ground during loading and unloading.

The side members are extended towards the front end 18 by two converging branches 19 and 20 arranged approximately at the same higher level as the rear end arms. They effect a general "V" shape, converging to a forwardly directed point 21 in a median zone determined by the general vertical median plane of the wagon structure and an upper horizontal plane which may be that defined by the two higher parallel edges of the side members.

Figure 5:
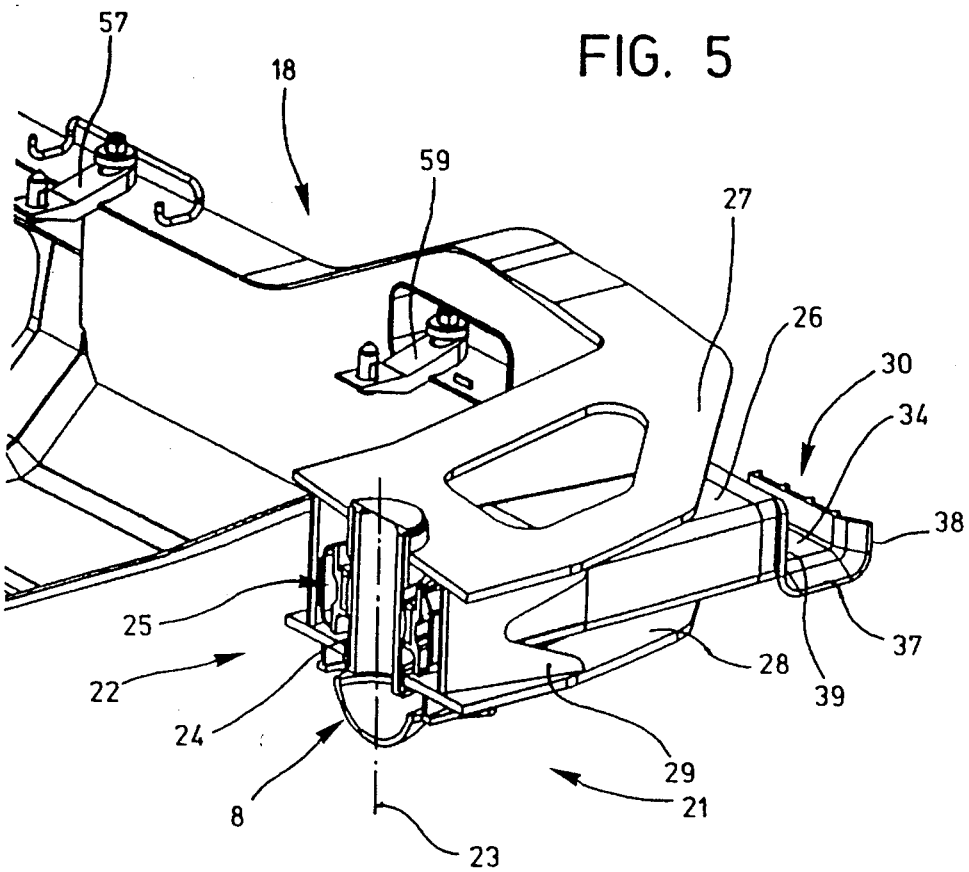
FIG. 5 is a detailed perspective view of one of the arms and of the rear end of the wagon structure cut through a median plane at the level of the common articulated assembly.

The bifurcated "V"-shaped front end 18 is firmly connected to a common central articulated pivoting assembly 22 with a common geometric axis 23 as seen in FIG. 5. This articulated assembly 22 shown schematically in FIG. 5 comprises a cylindrical pivot 24 to which is firmly connected the point 21 of the "V"-shaped front end 18 and on which is pivotally mounted an internal joint 25 of the simple rolling contact type or with ball-effect rolling contact, the articulated assembly 22 being mounted on the center-casting 9.

A pivoting cross member 26 is integrated mechanically into the front end 18, this front end being effected by two spaced plates 27 and 28 kept separated by a strut 29 and mounted on the common articulated assembly 22, and the pivoting cross member 26 is also mounted on this articulated assembly 22 by the internal joint 25 and is accommodated in the space between the two plates 27 and 28 of the front end 18.

According to the embodiment used as the basic variant, the two plates 27 and 28 forming the front end 18 are firmly connected to the cylindrical pivot 24 which itself pivots with respect to the bogie.

In an elaborated version the front end 18 may be separable from the articulated assembly 22.

The internal joint 25 facilitates the pivoting movements made by the cross member. As indicated, this joint 25 may have an additional degree of freedom by being of the mixed pivot/ball type so as to permit slight inclined deflections such as those caused by rocking and pitching movements.

The pivoting cross member 26 thus has mechanical degrees of freedom, in particular for independent pivoting movements. However, it is sandwiched between the two spaced plates 27 and 28 at the front end 18 and limited in angular deflection by the strut 29.

As mentioned above, the pivoting joint of the end of the load-bearing structure and the upper and lower joints have a common axis 23.

At each of its ends the pivoting cross member 26 comprises a receiving support 30, 31 enabling the establishment, maintenance and separation of the junction between the ends of the pivoting cross member and the ends 32, 33 of the arms of the rear end of an adjoining wagon structure to be ensured.

Figure 6:
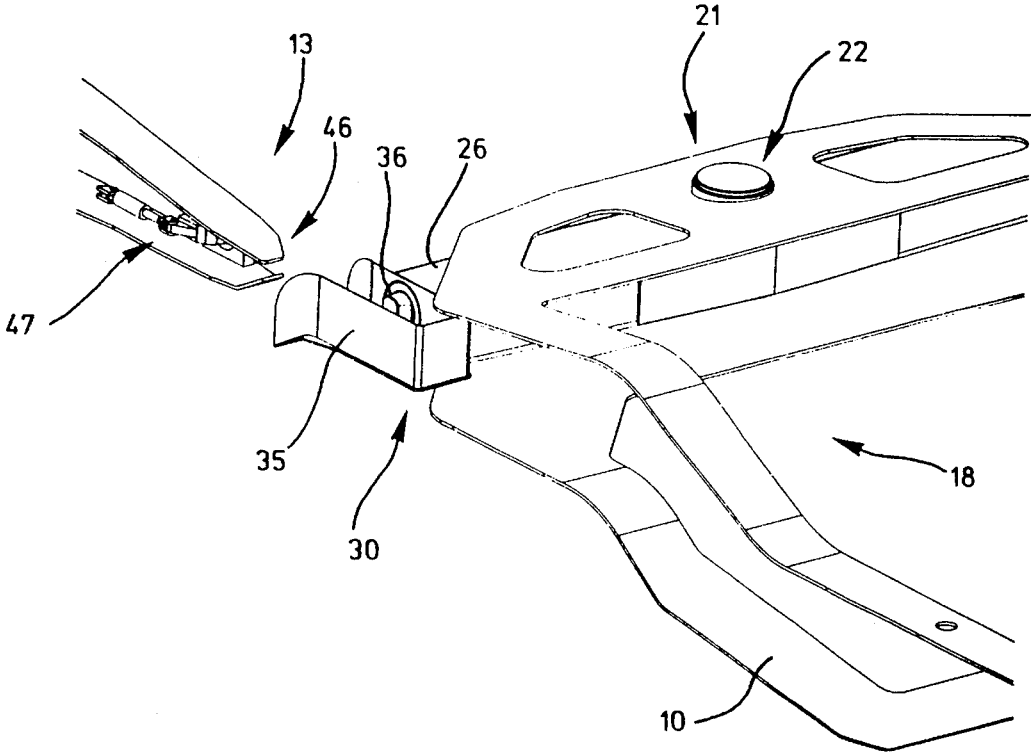
FIG. 6 is a schematic perspective view, with transparent lateral walls, of the junction and receiving means of two successive structures before coupling of one of the arms.
Figure 8:
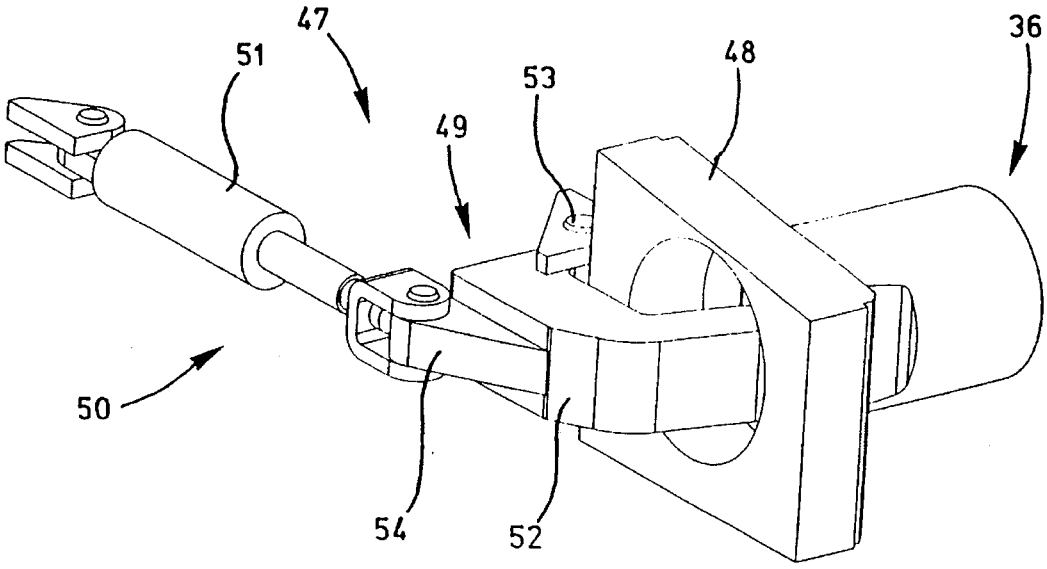
FIG. 8 is a perspective view of the junction means formed by the disengaging device and a receiving member.

Each receiving support 30, 31 is formed as a cradle 34 or receptacle 35 of bent sheet metal, as seen in FIG. 6, and in each of which there emerges a transverse pin such as 36, as seen in FIG. 8, which is mounted so as to be movable transversely and resiliently in a reciprocably biased manner towards its extended position. Each cradle or receptacle 34 and 35 effects the general shape of a gutter, on the one hand, with inclined lower inlet ramps 37 and, on the other hand, with converging lateral inlet ramps 38, 39 to the right and left.

Owing to the guiding function performed thereby, these ramps permit engagement and positioning in the same movement of the ends of the arms in the receiving supports and slight automatic height adjustment of the ends of the side sills so as to bring them to the same level as the pivoting cross member, that is to say into the rolling position.

In a simplified variant, the front end 18 is formed of a single plate and may be vertically separated from the bogie. In this case, the cross member is free since it is not sandwiched and loading/unloading by vertical separation applies fully.

Figure 7:
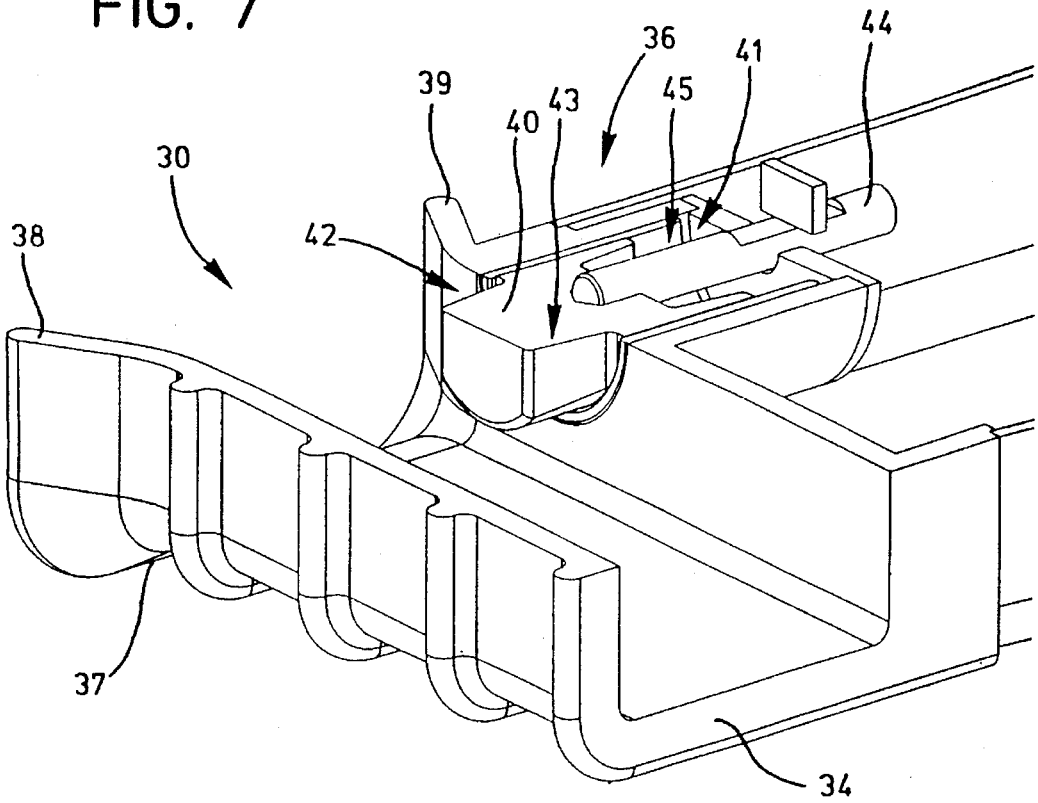
FIG. 7 is a partially sectional perspective view of a receiving support for the pivoting cross member, showing a retractable immobilizing pin.

We shall now examine in more detail, with reference to FIGS. 6 to 8, the junction means provided at the end of each arm of the side sill and designed to cooperate with the receiving/immobilizing means provided at each of the ends of the pivoting cross member with a view to establising a separable connection.

First of all, the receiving/immobilizing means comprise the receiving supports and the transverse immobilizing pins such as 36 which are movable transversely between a retracted position and an extended position towards which they are compelled by a return spring.

Each immobilizing pin may have a cylindrical body 40 sliding in a cylindrical receptacle 41 and a head with two bevelled edges 42 and 43, which are slightly inclined for example, as shown in FIG. 7. In this Figure, it is also possible to see a guiding rod 44 and a receptacle 45 in which there is mounted a return spring (not shown).

The junction means themselves relate firstly to the converging shape of the ends of each arm of the side sill formed, for example, by a plurality of ramps converging towards a tapered end 46.

In each of these ends there is accommodated an engagement/extraction mechanism such as 47 visible in FIGS. 6 and 8.

It comprises a receiving member 48 in the aperture of which there engages the immobilizing pin 36 and a disengaging device formed of a rocker 49 actuated by an articulated member 50 with an adjustable connecting rod 51 or the like. The rocker 49 comprises an angled disengaging member 52 which is pivotably articulated on the one hand to a pivoting shaft 53 and on the other hand to the end of the connecting rod 51 by a pivotable lateral rod-end strap 54.

Support of the end of the bent angled disengaging member 52 on the head of the retractable immobilizing pin 36 permits extraction of the receiving member 48 and freeing of the corresponding end of the side sill. Complete separation is then effected by short longitudinal displacement.

Owing to these automatic junction means and receiving/immobilizing means with mechanical disengagement, at the time of performing the coupling operations, the multiple precentering adjustments required with devices featuring guide pin centering, for example, are avoided. In fact, the height adjusts automatically and centering/guiding is ensured by the inlet ramps provided at the ends of the receiving supports and at the tapered end of each arm.

Figure 4:
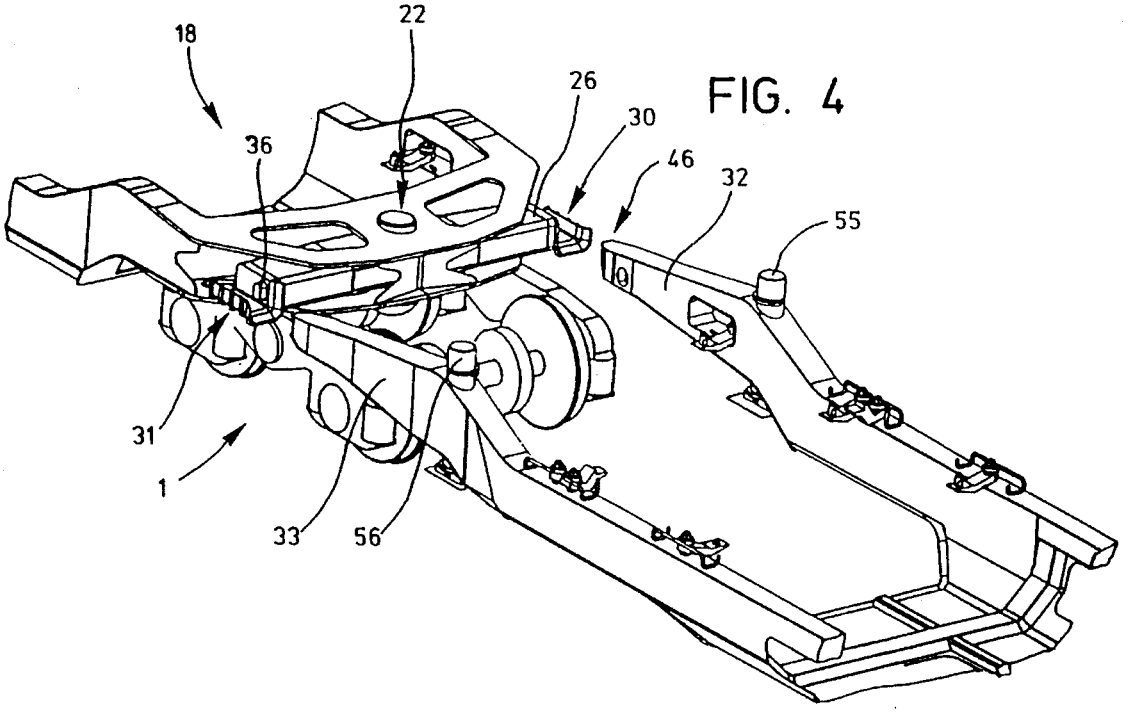
FIG. 4 is a perspective view of the opposing ends of two successive wagon structures before linking the same together.

In order to permit pivoting and a first height adjustment of one or the other end or of both ends simultaneously, the wagon structure optionally comprises, in the vicinity of its ends, individual, preferably autonomous, lifting means optionally with or without integral rolling, for example props 55, 56 provided at each of the ends of each side member, at a single end of the wagon structure or at both ends thereof, as seen in FIG. 4.

The type of prop envisaged is that of a retractable and extendable, for example telescopic, prop. The props may he hydraulic or even manually actuated.

To permit totally autonomous displacement of the train wagon structure by oblique transverse movement, it is possible to provide the base of each prop 55, 56 with directional or fixed axis rolling means.

In the case of a fixed axis, the constant general direction thereof is radial, that is to say passing through the pivot center.

According to an advantageous embodiment, it is possible to combine these rolling means with extendable props.

Thus, the lower ends of the props are mounted on a pivoting roller table.

Figure 3:
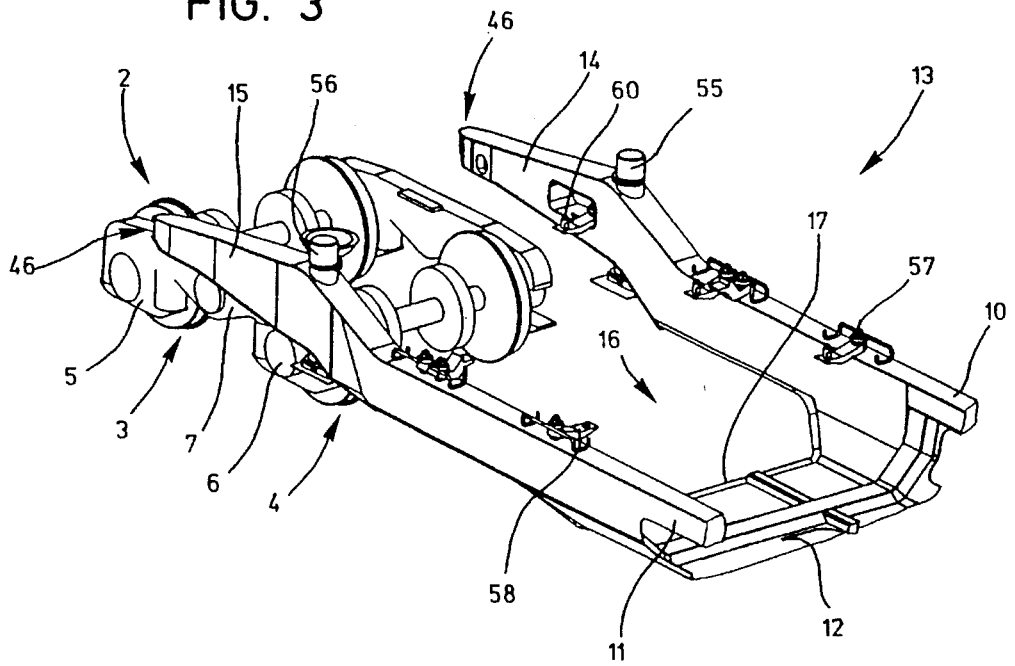
FIG. 3 is a perspective view of the rear end of the wagon structure and of the bogie on which it is designed to be mounted.

To permit the loading of standard or non-standard containers, it is possible to provide, on the upper edges of the side members, twistlocks such as are shown in FIG. 3 at 57 and 58 interacting with the lower corner members of the containers with a view to their firm connection with the wagon structure.

In order to admit large containers, four additional twistlocks are provided, two of which are at the front, such as 59, and two of which are at the back, such as 60, as seen in FIG. 1. These twistlocks are supported by a retractable plate which permits the assembly to retract into the wall of each of the ends of each of the side members.

In general, several methods of proceeding with the loading/unloading operations are possible with the rail transport unit coupled by the coupling assembly according to the invention.

The following loading/unloading methods may be distinguished.

First mention is of linear or longitudinal loading/unloading, according to which the series of rail transport units is separated at the level of the couplings between load bearing structures without any other movement than that of longitudinal connection and disconnection of the junction means.

Thereafter, mention may be made of oblique loading/unloading, according to which the rear ends of the load bearing railroad structures are disengaged from the neighboring supporting structure by a retraction/disengagement movement followed by one of rotation as far as an obliquely displaced position permitting oblique longitudinal penetration into the load bearing structure through its transverse end opening with a view to its loading/unloading.

Final mention is of vertical loading/unloading by an external handling means possible in the case of a variant with a separable front end and more particularly with a single plate front end.

The various methods of loading/unloading will be described in more detail below.

The first method relates to linear or longitudinal loading/unloading.

This method of loading/unloading requires a loading area with rails integrated into the ground.

According to this method, the rail transport unit is connected or disconnected by a longitudinal, horizontal displacement movement of its open end effected by external means. The road haulage unit is loaded or unloaded, either directly along linear load bearing displacement structures, or indirectly through the intermediary of one or more transverse mobile load bearing structures on which rests the road train.

The oblique loading/unloading operations will now be examined, which enable all these operations to be effected without any modification to the railroad train, that is to say independently of the other railroad units which it may comprise.

Loading/unloading is effected by moving the rear end into an oblique position after disconnection from the neighboring load bearing structure by any means, for example by props, then oblique displacement by rolling along the loading platform, during which operation the load bearing structure pivots as a unit about its front end, gaining pivotal support from the front bogie.

After loading of a road vehicle, for example, the load bearing structure is brought laterally back towards its starting position by a pivoting movement of the assembly in the same manner as previously done but in reverse order.

The lifting means, for example integral in the form of props, raise the front ends of the side members, and position them opposite the connecting/locking means of the front end of the subsequent load bearing structure.

After coupling and locking, the load bearing structure is ready in the train with its new load for railroad transport.

All unloading operations are effected in a reverse order as those of the loading operations.

On the other hand, owing to the means of lifting the two ends, when provided, it is possible to deposit the wagon structure by transverse or longitudinal displacement in the case of vertically separable variants also at the front end.

The means for lifting the rear end, such means being integral with the wagon structure or thereof, permit, after opening of the additional safety bolts (not shown), disconnection of the junction means and the achievement of the disconnection of the wagon structure from the bogie interface. A rotational movement about the front end ensures disengagement of the rear end by oblique displacement.

The front end is then disconnected and brought out of the alignment of the train.

The simplest, most conventional method relates to vertical disconnection and transportation by an external lifting appliance which is only possible here with the vertically separable variants.

It is sufficient, to free possible blockages or locking, to disconnect the junction means from the ends of the adjoining wagon structures and to effect slight longitudinal displacement (elaborated variant), then to lift the assembly by a lifting appliance whose gripping elements and members are based on technical forms and structures specially provided to this end.

This lifting of the assembly permits the extraction from the train of the rail transport unit with its load, the same elsewhere while waiting, or insertion with its load into another railroad train.

Means of lifting the two ends permit the removal for the wagon structure by transverse or longitudinal displacement.

The above-described means offer the possibility of selecting and effecting the loading/unloading method best suited to the load (container, road-haulage unit or the like) and to the design of the yard handling area, of the train and of the constraints and peculiarities of the marshalling operation.

It goes without saying that various obvious modifications and simple variants come within the scope of the present invention beyond the above-described means. It is therefore to be understood that within the scope of the appended claims, the present invention may be practiced otherwise than as specifically described herein.

I claim:

1. An assembly for coupling two opposite ends of two successive wagon structures to the same bogie, comprising:

a first wagon structure having a front end and a rear end;

a second wagon structure having a front end and a rear end;

a bogie having pivot means fixedly mounted thereon and to which said front end of said first wagon structure is pivotally connected so as to permit pivotal movement of said first wagon structure with respect to said bogie; and means mounted upon said front end of said first wagon structure for connection to said rear end of said second wagon such that said second wagon structure is connected to said first wagon structure and said first wagon structure is connected to said bogie whereby opposite front and rear ends of said first and second wagon structures are connected to the same bogie.

2. An assembly as set forth in claim 1, wherein:

each one of said wagon structures comprises side members connected together by means of an underslung base.

3. An assembly as set forth in claim 1, wherein:

said rear end of said second wagon structure comprises a pair of laterally spaced, rearwardly extending arms; and said means mounted upon said front end of said first wagon structure comprises a pair of laterally spaced cradle receptacles for receiving said laterally spaced arms of said second wagon structure.

4. An assembly as set forth in claim 3, wherein:

said pair of laterally spaced cradle receptacles are defined upon opposite lateral sides of a cross member pivotally connected to said pivot means of said bogie.

5. An assembly as set forth in claim 4, wherein:

said front end of said first wagon structure comprises a pair of vertically spaced plates through which said pivot means of said bogie passes; and said cross member is interposed between said vertically spaced plates of said front end of said first wagon structure.

6. An assembly as set forth in claim 3, further comprising:

locking means defined between said laterally spaced cradle receptacles of said first wagon structure and said laterally spaced arms of said second wagon structure for releasably maintaining said second wagon structure connected to said first wagon structure.

7. An assembly as set forth in claim 6, wherein:

said locking means comprises extendable/retractable pin means mounted within said cradle receptacles of said first wagon structure, and extendable/retractable socket means mounted upon said arms of said second wagon structure.

8. An assembly for coupling two opposite ends of two successive wagon structures to the same bogie, comprising:

a first wagon structure having a front end and a rear end;

a second wagon structure having a front end and a rear end;

a bogie to which said first and second wagon structures are to be connected;

pivot means fixedly mounted upon said bogie for pivotally mounting said front end of said first wagon structure thereon so as to provide pivotal movement of said first wagon structure with respect to said bogie; and means mounted upon said front end of said first wagon structure for supportably connecting said rear end of said second wagon structure to said front end of said first wagon structure, whereby said front end of said first wagon structure is pivotally connected to said bogie by said pivot means, while said rear end of said second wagon structure is also connected to said bogie through the intermediary of said front end of said first wagon structure.

9. An assembly as set forth in claim 8, wherein:

said rear end of said second wagon structure comprises a pair of laterally spaced, rearwardly extending arms; and said means mounted upon said front end of said first wagon structure for supportably connecting said rear end of said second wagon structure comprises a pair of laterally spaced cradle receptacles for receiving said laterally spaced arms of said second wagon structure.

10. An assembly as set forth in claim 9, wherein:

said pair of laterally spaced cradle receptacles are defined upon opposite lateral sides of a cross member pivotally connected to said pivot means of said bogie so as to provide pivotal movement of said rear end of said second wagon structure with respect to said bogie when said laterally spaced arms of said second wagon structure are disposed within said laterally spaced cradle receptacles of said first wagon structure.

11. An assembly as set forth in claim 10, further comprising:

locking means defined between said laterally spaced cradle receptacles of said first wagon structure and said laterally spaced arms of said second wagon structure for releasably retaining said arms of said second wagon structure within said cradle receptacles of said first wagon structure.

12. An assembly as set forth in claim 11, wherein:

said locking means comprises extendable/retractable pin means mounted upon said cradle receptacles of said first wagon structure, and extendable/retractable socket means mounted upon said arms of said second wagon structure.

13. An assembly as set forth in claim 10, wherein:

said front end of said first wagon structure comprises a pair of vertically spaced plates through which said pivot means of said bogie passes; and said cross member is interposed between said vertically spaced plates of said front end of said first wagon structure.

14. An assembly for coupling two opposite ends of two successive wagon structures to the same bogie, comprising:

a first wagon structure having a front end and a rear end;

a second wagon structure having a front end, and a rear end comprising a pair of laterally spaced arms;

a bogie to which said first and second wagon structures are to be connected;

pivot means fixedly mounted upon said bogie for pivotally mounting said front end of said first wagon structure thereon so as to provide pivotal movement of said first wagon structure with respect to said bogie; and a cross member mounted upon said front end of said first wagon structure so as to be pivotable about said pivot means of said bogie and comprising laterally spaced cradle receptacles for housing said pair of laterally spaced arms of said second wagon structure, whereby said front end of said first wagon structure is pivotally connected to said bogie by said pivot means, and said rear end of said second wagon structure is pivotally connected to said bogie through the intermediary of said cross member mounted upon said front end of said first wagon structure and pivotable about said pivot means of said bogie.

15. An assembly as set forth in claim 14, wherein:

said front end of said first wagon structure comprises a pair of vertically spaced plates through which said pivot means of said bogie passes; and said cross member is interposed between said vertically spaced plates of said front end of said first wagon structure.

16. An assembly as set forth in claim 14, further comprising:

locking means defined between said laterally spaced cradle receptacles of said first wagon structure and said laterally spaced arms of said second wagon structure for releasably retaining said arms of said second wagon structure within said cradle receptacles of said first wagon structure.

17. An assembly as set forth in claim 16, wherein:

said locking means comprises extendable/retractable pin means mounted upon said cradle receptacles of said first wagon structure, and extendable/retractable socket means mounted upon said arms of said second wagon structure.

18. An assembly as set forth in claim 14, wherein:

each one of said wagon structures comprises side members connected together by means of an underslung base.

* * * * *